US007762144B2

(12) United States Patent
Walker et al.

(10) Patent No.: US 7,762,144 B2
(45) Date of Patent: Jul. 27, 2010

(54) METHOD AND APPARATUS TO PERFORM PROFILE MEASUREMENTS ON WET CEMENT AND TO REPORT DISCREPANCIES

(75) Inventors: Roger S. Walker, Lantana, TX (US); Emmanuel G. Fernando, College Station, TX (US)

(73) Assignee: Board of Regents, The University of Texas System, Austin, TX (US)

( * ) Notice: Subject to any disclaimer, the term of this patent is extended or adjusted under 35 U.S.C. 154(b) by 0 days.

(21) Appl. No.: 11/877,328

(22) Filed: Oct. 23, 2007

(65) Prior Publication Data

US 2009/0103978 A1 Apr. 23, 2009

(51) Int. Cl.
*G01N 3/00* (2006.01)

(52) U.S. Cl. ..... 73/803; 106/790

(58) Field of Classification Search ..... 73/803
See application file for complete search history.

(56) References Cited

U.S. PATENT DOCUMENTS 4,210,304 A * 7/1980 Mannina ..... 249/22
4,335,065 A * 6/1982 Ando ..... 264/87
6,227,761 B1 * 5/2001 Kieranen et al. ..... 404/84.5
7,044,680 B2 5/2006 Godbersen et al. ..... 404/75
2006/0288912 A1 * 12/2006 Sun et al. ..... 106/790

OTHER PUBLICATIONS

Gomaco, "GSI® Gomaco Smoothness Indicator ASAP Smoothness Readings," 8 pages, 2005.
Gomaco, "GSI® Utility Vehicle," 1 page, 2005.

* cited by examiner

*Primary Examiner*—Max Noori
(74) *Attorney, Agent, or Firm*—Fulbright & Jaworski L.L.P.

(57) ABSTRACT

An apparatus, method, and system are disclosed, which provide a means of real time surface profile evaluation in wet cement. The sliding profiler can be pulled behind various stages in a paving train. The user is alerted to profile discrepancies while the cement is still pliable and afforded the opportunity to make adjustments to the paving process, to include additional finishing. The system is made of affordable components and thus is appropriate for construction projects of different scale. In addition, multiple sliding profilers can measure the profile of multiple wheel paths simultaneously. The system can measure profile changes of less than 150 mils. Use of the system described herein will contribute to better roadways at lower costs.

11 Claims, 16 Drawing Sheets

METHOD AND APPARATUS TO PERFORM PROFILE MEASUREMENTS ON WET CEMENT AND TO REPORT DISCREPANCIES

STATEMENT REGARDING FEDERALLY SPONSORED RESEARCH OR DEVELOPMENT

Research was performed in cooperation with the Texas Department of Transportation and the Federal Highway Administration, TXDOT Research Project 0-4385.

BACKGROUND OF THE INVENTION

The present invention relates generally to the field of cement paving. More particularly, the present invention relates to evaluating the surface profile of recently laid cement in real time.

During new construction and during resurfacing, large surfaces are paved with concrete. Once set, the cement cannot be readily reshaped. In a worst case scenario, large cement pours have to be ground because the dried surface is unsatisfactory. These grinding procedures are expensive, time consuming, and labor intensive. This is one reason that pavers, such as paving contractors and departments of transportation, desire a method and system for ascertaining and measuring surface discrepancies in cement when alternate methods of correction are still possible.

Typically, re-surfacing by adding an additional top layer is not possible due to bonding inadequacy. A restriction on the total height of the pavement slab can limit any finishing which adds height.

The paved concrete surface effects environmental parameters to include noise generation induced from traffic traversing the pavement. When set concrete has to be removed and replaced, the removed concrete creates large amounts of waste.

The texture of concrete surfaces has economic impacts. The pavement surface can directly affect tire wear, to include tread and studs. Pavement surfacing effects safety conditions, as well. The pavement surface will impact skid resistance and water drainage. On pedestrian surfaces, the paved surface can effect the safe ride of recreational equipment, such as inline skates. Pedestrian traffic can lead to surface concerns on many paved surfaces, in addition to sidewalks. For example, concrete surfaces may need to be able to accommodate persons using walking assistive devices.

Differences in use, purpose, terrain, and weather can all require different surface types and tolerances. For example, an area designed for skateboarding would have different surface standards than either a pedestrian walkway, or a street. A flat area with high rainfall and high traffic may have different surface tolerances as compared to a gradual slope in an arid environment with very little traffic. Different uses, such as interstate highway, racing track, canal, and aircraft runway, will all have different surface standards.

The surface of the pavement can affect load impact, which in turn can affect the service life of the pavement. Methods to evaluate and correct roadway pavement when the cement is still plastic, able to be reshaped, can have immediate effects, such as skid resistance, and long term effects, such as load impact and road wear. By detecting surface defects before the cement is set, economical and effective surface correction is possible.

Conventionally, cement for large concrete slabs and roadways is laid using a slip-form paver or a fixed form paver. Concrete is poured, smoothed with a trowel, and allowed to cure before inertial surface profile, smoothness, characteristics are measured to assess compliance with surface standards and goals. Irrespective of the type of paving employed, jointed plain (JPCP), jointed reinforced (JRCP) and continuously reinforced (CRCP), surface measurements are conventionally made after the cement has set. FIG. 1 shows a paving train 100 with a spreader 110, followed by a paver 120, which is followed by a finisher 130. The paver 120 shown in FIG. 1 is a conventional slip-form paver. And FIG. 2 shows a conventional walking profiler 200, which is used to make surface measurement and is manually pushed on set cement.

Conventionally, finishers follow behind a paver and perhaps a working bridge, troweling the wet cement to a smooth surface. By identifying bumps or indentations which exceed the desired surface roughness, right after the cement has been laid, finishers can re-trowel the deficient surface with little or no retracing of steps. Corrections could be made with little or no additional labor, operation, or material costs.

Conventional real time bump detectors include those developed by Ames Engineering (Ames Engineering, Ames, Ind., U.S.A.) and Gomaco (Gomaco, Ida Grove, Ind., U.S.A.) The Ames device uses three laser sensors which measure displacements between the wet concrete and a beam extending out from the paving device. However the device has high costs, which include the cost of each laser.

Godbersen et al. (U.S. Pat. No. 7,044,680) uses non-contact, e.g. sound wave reflection, sensors. Discrepancies to include bumps in wet concrete can be identified and estimated using non-contact sensors with a slope sensor, detecting the slope of the sensor beam. The apparatus can be mounted behind a road paving machine to provide real time feedback. The system is not, however, readily attachable to an existing paver, and requires a dedicated expansive rig.

An economical device is desirable for widespread implementation by various pavers and for projects of smaller size, as well. It would be desirable if an apparatus, system, and method could provide bump detection at low cost. It would also be desirable if existing pavers could readily, or be readily modified to, accommodate the bump detector, surface profiler.

In addition to the considerations above, transportation departments may have ride quality and/or surface smoothness criteria for paved roadways. To assist contractors and pavers in meeting or exceeding these surface and ride quality standards, evaluation of the surface quality of wet cement is desirable. For these reasons and those discussed above, a method for early bump detection for use during pavement construction of, e.g. Portland Cement Concrete (PCC), pavements is desirable. If a method to check surface smoothness while paving is available, early detection of non-compliant areas may lead to more cost-effective alternatives for correcting deficiencies.

While existing specifications may stipulate that the cost for correcting deficiencies is to be borne by the contractor, in reality, penalties may be factored into the contractor's bid. Thus, if a method for early bump detection is available for the contractor to use, the reduction in his or her risk could potentially translate to a lower bid with the result that a superior riding pavement is obtained at less cost.

A surface profiler and bump detector would need to be able to withstand the paving environment, which may include vibration, jerking, water spray, and chemicals.

The construction of smooth and durable pavements is a major objective in roadway construction projects. Transportation departments may develop and revise ride quality specifications. When quality assurance is conducted on dry set cement, these specifications may call for remedial action after the concrete has hardened, which is expensive. Then, it may become necessary to grind the concrete, which leaves a permanent scar for the life of the pavement. If early detection of inadequate ride or smoothness in PCC pavements was possible and affordable, corrective measures could be taken before the concrete has hardened. And in turn, a better product at less cost could potentially be achieved.

Paving contractors, flat floor slab contractors, engineers, departments of transportation, Federal Highway Authorities, and Federal Aviation Authorities could all benefit from an economical, accurate, and easy to implement method of surface measurements on wet cement.

SUMMARY OF THE INVENTION

The present invention provides an apparatus, system, and method for measuring surface profile on recently laid cement and overcomes one or more disadvantages described above.

One aspect of the present invention is real time measurement and detection of surface discrepancies in recently laid cement to provide pavers with the information to rework paving still in the plastic, shapeable, state.

Another aspect of the present invention is that the timely feedback associated with the present invention affords pavers the opportunity to adjust the material, laying, or finishing in progress. Still another aspect of the present invention is the graphic display of the surface profile data which can be readily monitored and interpreted by the user.

The surface profile information and data acquired in accordance with the present invention can be used alone or in conjunction with other measurements to assess and estimate, for example, noise characteristics or skid resistance.

The surface profile information and data acquired in accordance with the present invention can be used to evaluate the performance and function of new paving methods and materials.

The present invention provides a system and method of real time quality control of cement paving.

The present invention can be used with a conventional slip-form paver or an alternate paver.

The present invention accommodates different finishing methods.

Embodiments of the present invention provide high performance and efficiency at low component costs.

Yet another aspect of the present invention is that discovered bumps can be detected, repaired, and checked again for surface adequacy while the cement is still in the plastic state.

In yet another embodiment, inadvertent momentary displacements of a working bridge are accounted for in the reporting of wet cement discrepancies.

Those skilled in the art will further appreciate the above-noted features and advantages of the invention together with other important aspects thereof upon reading the detailed description that follows in conjunction with the drawings.

BRIEF DESCRIPTION OF THE FIGURES

For more complete understanding of the features and advantages of the present invention, reference is now made to the detailed description of the invention along with the accompanying figures, wherein:

FIG. 9A shows the telescoping rod, while FIG. 9B shows the spring loaded and hinged angled bracket;

FIG. 10A shows conceptual diagram of an exemplary embodiment of the main data acquisition and processing components and their interconnections according to an exemplary embodiment, while FIG. 10B shows the measured variables in relation to the sliding profiler;

DETAILED DESCRIPTION OF THE INVENTION

The invention, as defined by the claims, may be better understood by reference to the following detailed description. The description is meant to be read with reference to the figures contained herein. This detailed description relates to examples of the claimed subject matter for illustrative purposes, and is in no way meant to limit the scope of the invention. The specific aspects and embodiments discussed herein are merely illustrative of ways to make and use the invention, and do not limit the scope of the invention.

Figure 1:
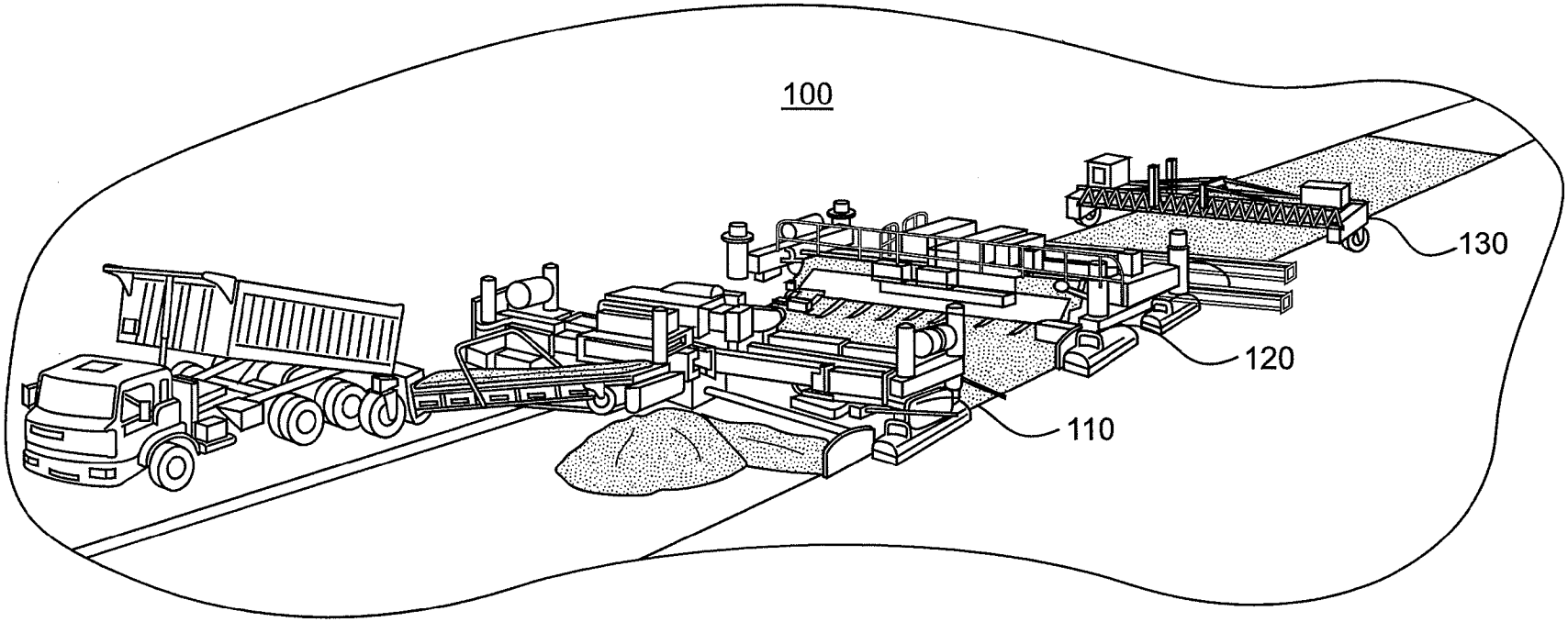
FIG. 1 shows a conventional paving train, with a spreader, followed by a paver, which is followed by a finisher.
Figure 2:
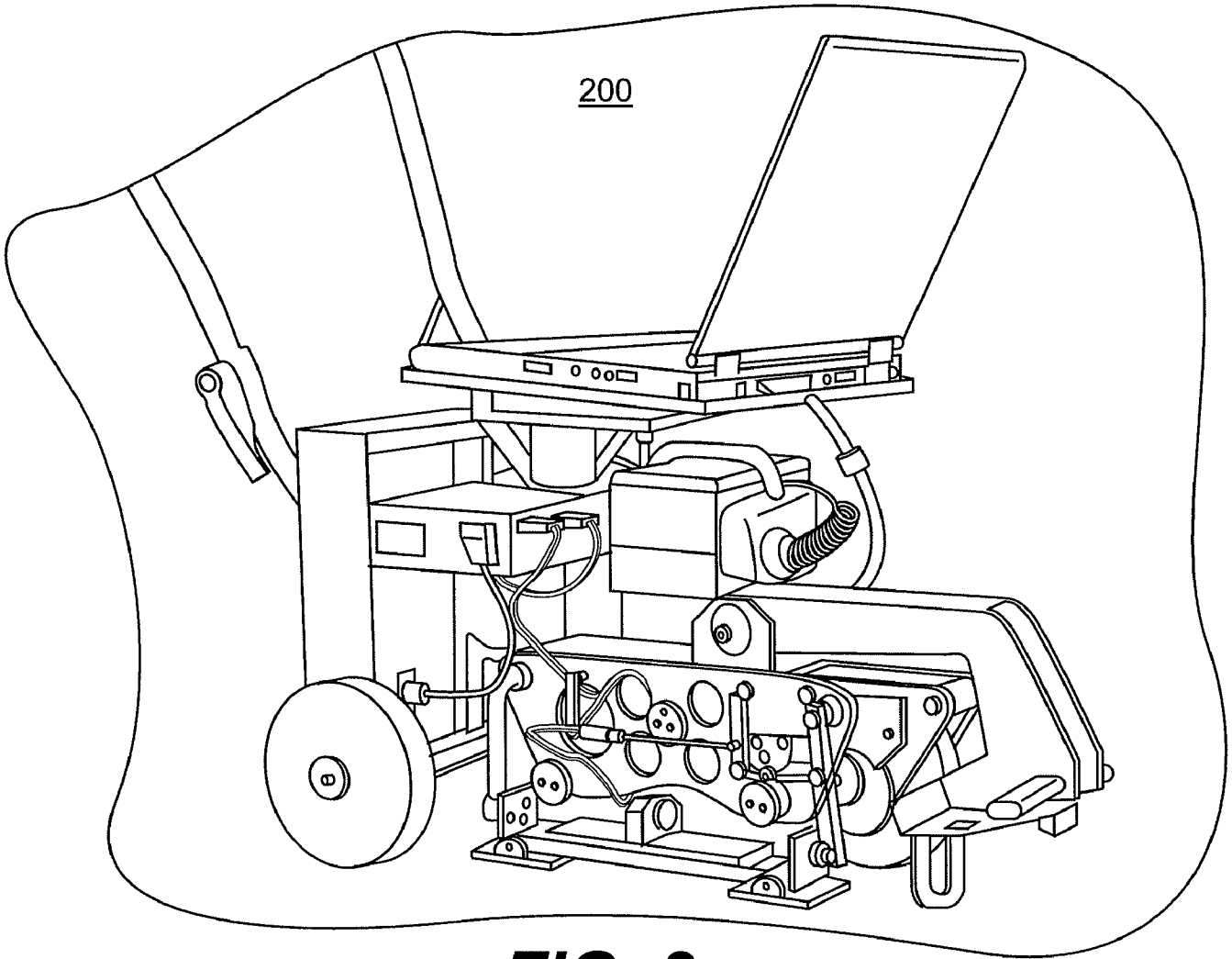
FIG. 2 shows a conventional walking profiler, which is manually pushed on dry set cement.

Like the conventional walking profiler, as shown in FIG. 2, a push cart surface profiler can also be used to assess the surface of set cement. FIG. 3 shows a push cart surface profiler. From tests conducted using a push cart profiler on set cement, it was found that the slower the push cart traversed the pavement the greater the profile sensitivity. That is, the slower the push cart moved along (set) cement, the smaller the changes in profile that the push cart would detect. The push cart employed a gyroscope and/or an inclinometer. Since the paving train moves very slow, a profiler pulled behind the paving train on the wet cement could potentially yield accurate surface measurements using an inclinometer or a gyroscope.

Figure 3A:
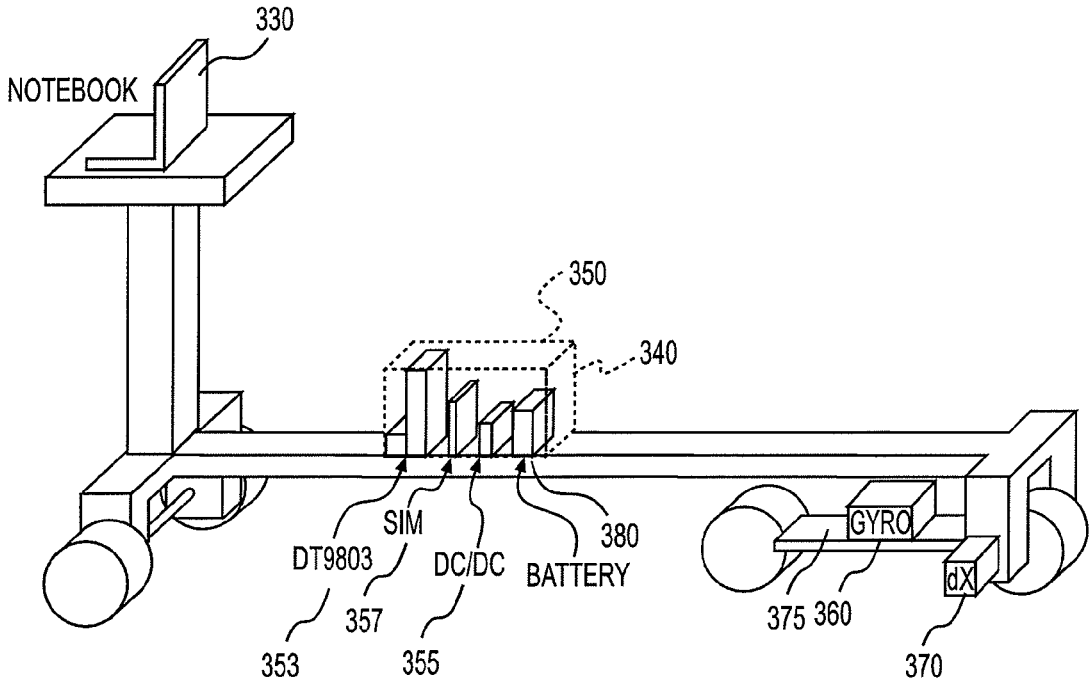
FIGS. 3A-3B show a push cart profiler for set cement and an exemplary interconnection of its components, respectively.

The main components of a push cart profiler are shown in FIG. 3A. The components shown, include a notebook computer 330 with an A/D unit 340 (not shown) for capturing the raw gyroscope sensor data, a signal module 350 which contained the power converter 355, battery 380, wireless module 357, and data acquisition module 353, a gyroscope (WAT- SON INDUSTRIES INC., Eau Claire, Wis., U.S.A.) 360, and a distance encoder 370 for determining distance traveled. In an alternate embodiment, an inclinometer replaced the gyroscope 360. The platform 375 was free to move up or down measuring the slope of the pavement traveled using either a gyroscope or inclinometer 360, as shown in FIG. 3A. In other embodiments, the wireless connection 357 may be omitted. In still other embodiments, the computer may be a handheld personal digital assistant (PDA) or a personal computer.

Figure 3B:
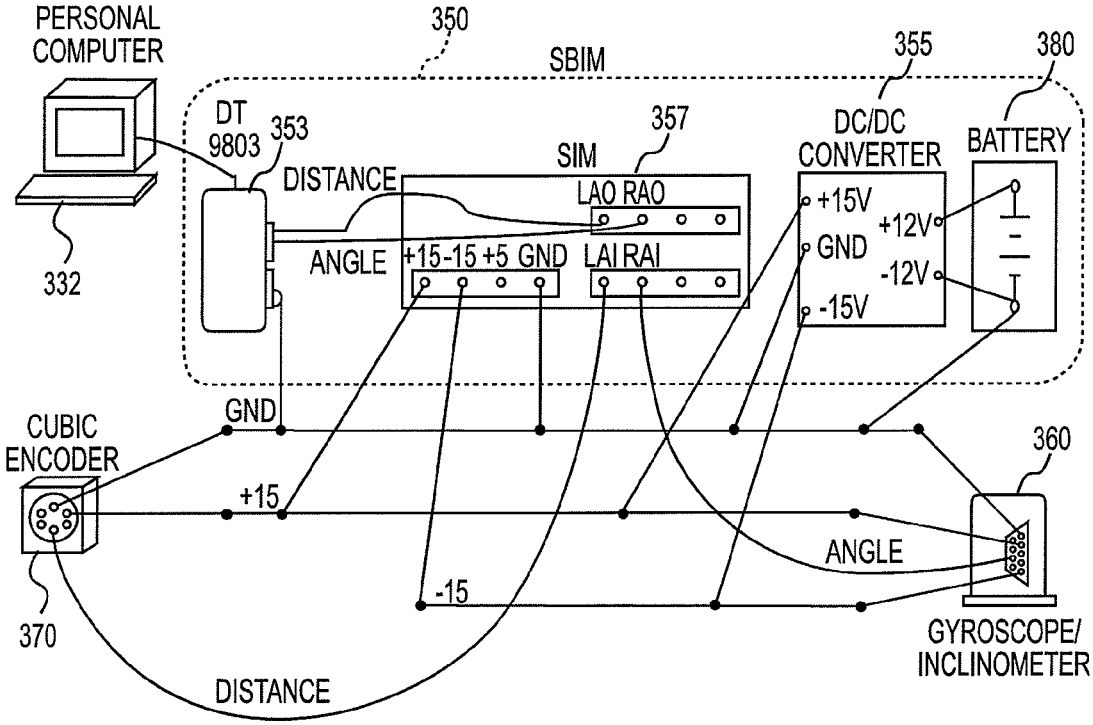

FIG. 3B shows a diagram of the electronic connections for the exemplary unit shown in FIG. 3A, except a personal computer 332 is shown instead of a notebook computer. A personal computer 332 using a DT 9803 data acquisition module 340 (DATA TRANSLATION, Marlboro, Mass., U.S.A.) along with an updated program for real-time measurements provides bump measurements.

Figure 4:
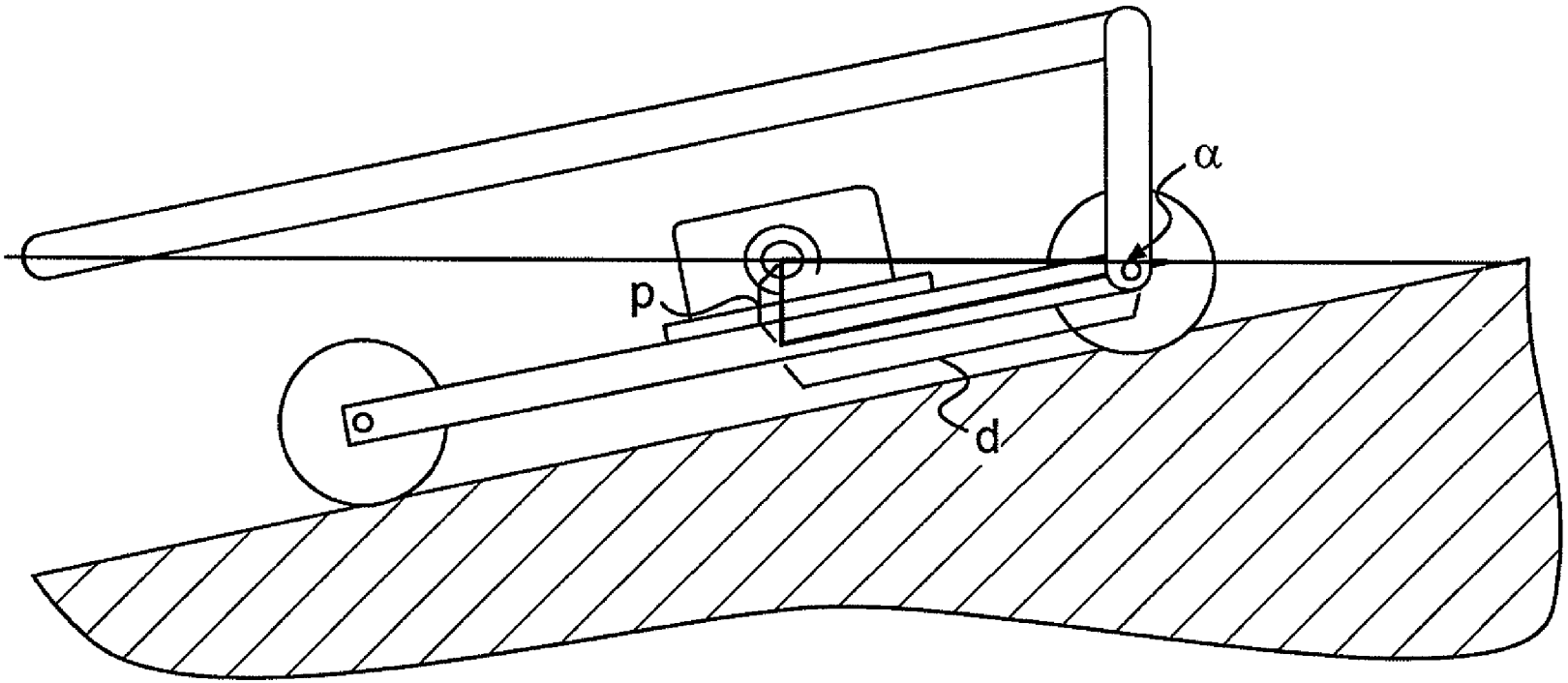
FIG. 4 illustrates the variables recorded and used to calculate the surface profile with the push cart profiler.

Referring to FIG. 4, as the push cart 300 moved longitudinally along the pavement, the gyroscope measured the slope (p/d) or displacement angles (a) of the floating measurement base 310. An estimate of the profile was then computed by the set of profiles computed by the sum of products of the length of the measurement platform and its angle with respect to the horizon.

Figure 5A:
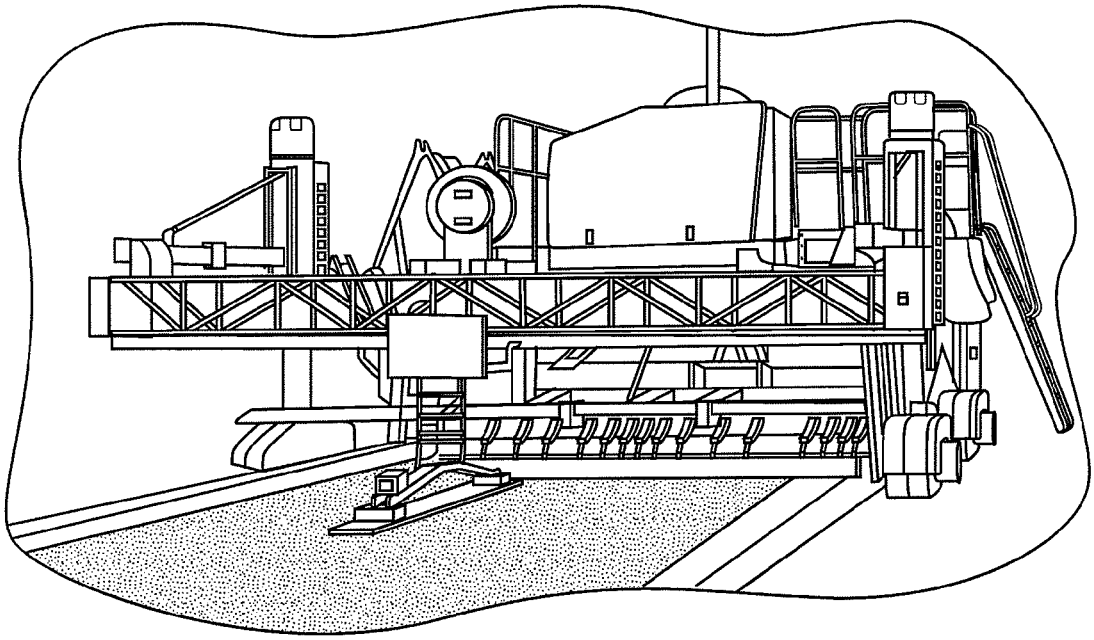
FIG. 5 shows an AUTO-FLOAT finisher attached to the back of a slip form paver.
Figure 5B:
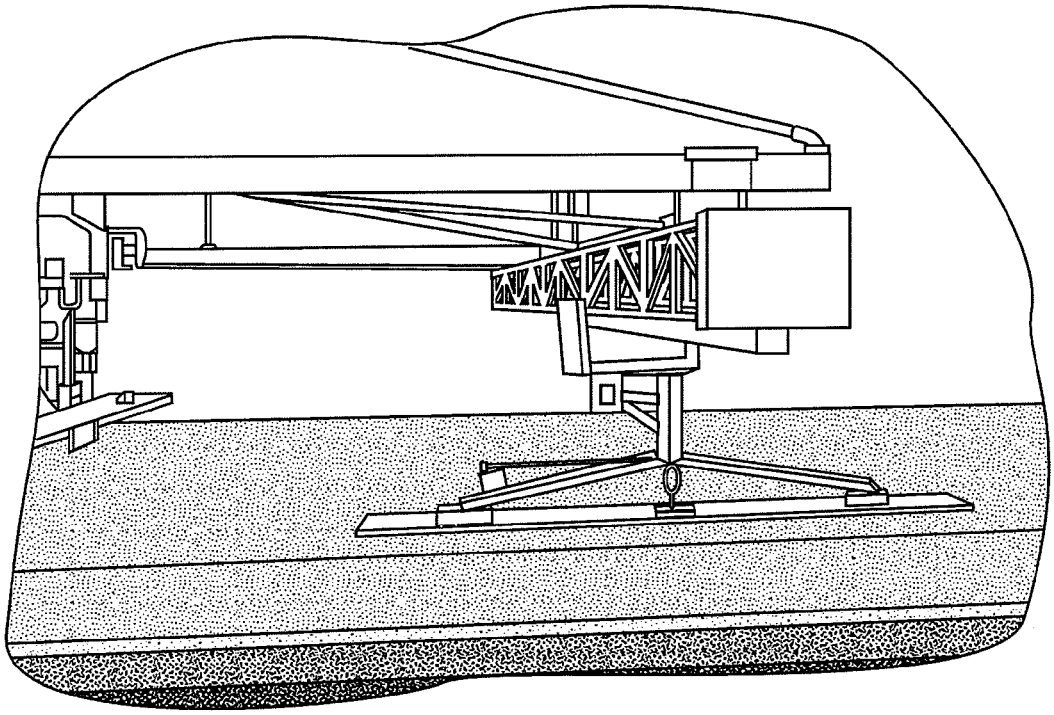
Figure 6:
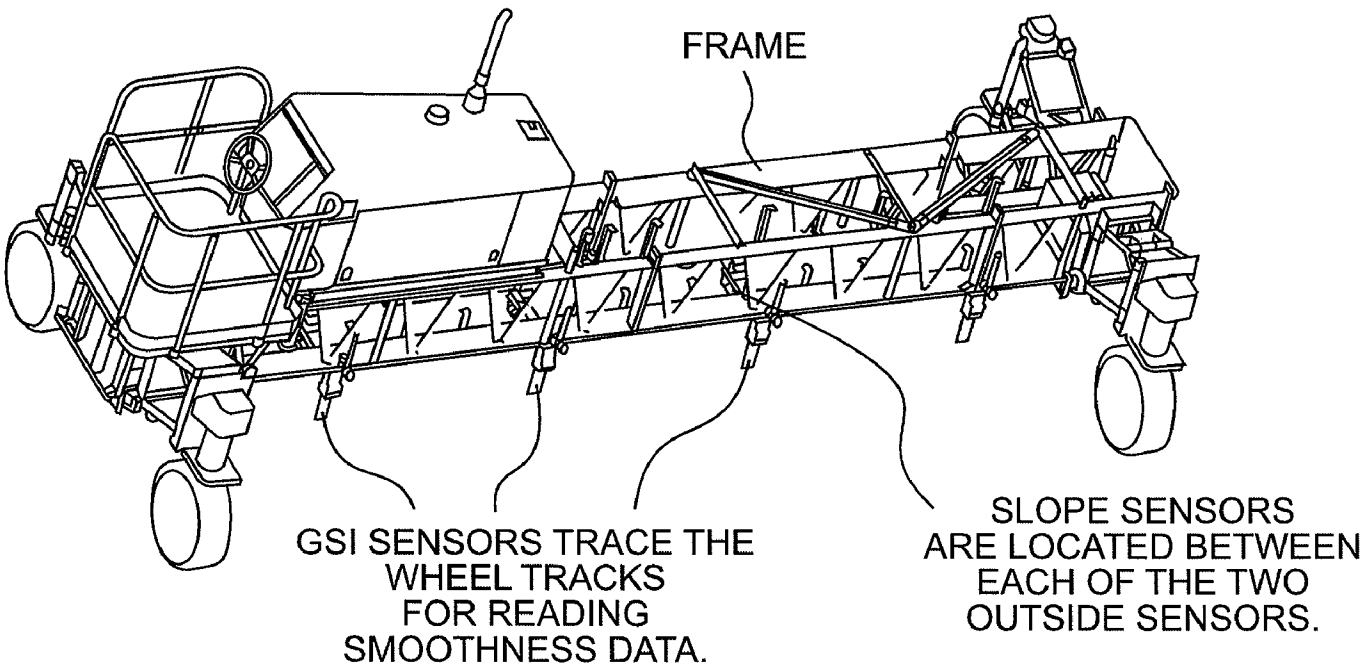
FIG. 6 (PRIOR ART)
FIG. 6 shows a conventional smoothness indicator mounted on a working bridge (GOMACO, Ida Grove, Iowa, U.S.A)

An AUTO-FLOAT (GOMACO, Ida Grove, Iowa, U.S.A.) is a finishing device which contacts but floats on the surface of recently laid cement, smoothing the surface. An AUTO-FLOAT typically attaches to the back of a slipform paver, as shown in FIG. 5. Further back in the paving train, Gomaco's surface profiler mounts across the bottom of a working bridge, as shown in FIG. 6 (GOMACO, Ida Grove, Iowa, U.S.A.).

A goal of the present invention was to create a surface profiler which could float on the wet cement and detect bumps or divets in the surface profile. It was also desirable to develop a surface profiler which could be easily attached and detached from the paving unit. Embodiments of the present invention float or slide along wet pavement behind a paving train while making surface profile measurements. As was noted above, a push cart would give much profile readings to a greater accuracy and sensitivity, the slower the push cart moved. A paving train conventionally moves very slow, so measurements made with a gyroscope at paving train pace, could potentially yield sensitive profile measurements. Additionally, since the sliding profiler would be on wet concrete, the data could be sent to a handheld PDA, small computer or notebook via a wireless link. If an inclinometer is used in place of a gyroscope, the costs per wheel path of such a system would be even lower.

The sliding profiler concept involves contact measurements via sensors that measure slope and distance while using a sliding platform to support hardware and software for data acquisition and real-time data processing. Since a slope sensor, inclinometer or gyroscope, is used in lieu of multiple lasers for elevation measurements, significant savings in instrumentation costs may be realized, making the unit more affordable and facilitating the deployment of multiple sliding profilers on a given paving project.

One of the challenges of the present invention is to create a sliding platform which will minimally disturb the surface of the wet cement and support the weight of the needed meters and electronics, while affording sensitive accurate measurements with an inclinometer or gyroscope. Exemplary embodiments of the present invention maintain a significant contact surface area to weight ratio and a smooth contact surface. Other embodiment include rounded edges and corners, other embodiments include a streamline, surfing or skiing type sliding platform.

Figure 7:
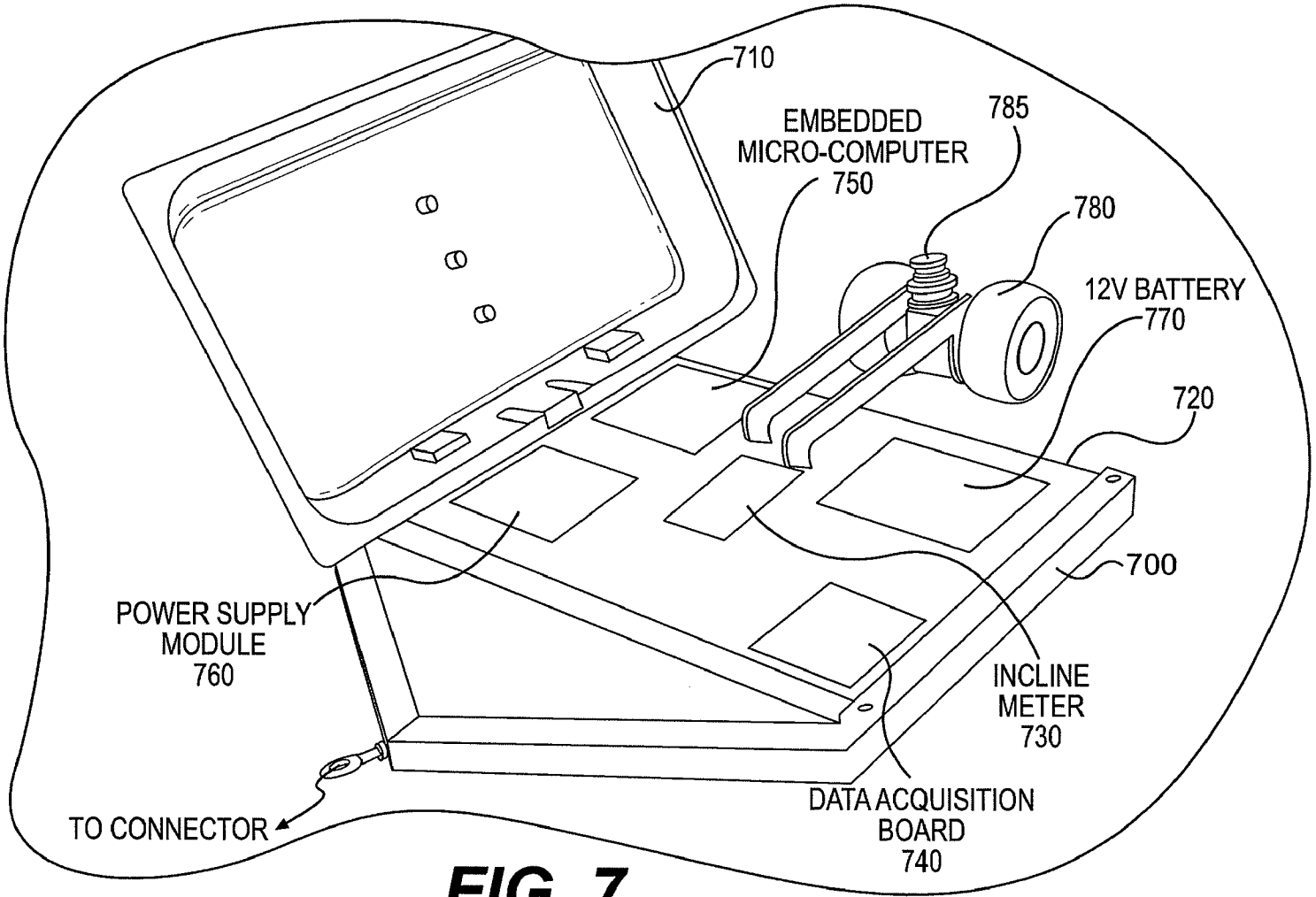
FIG. 7 shows an exemplary embodiment of the present invention.

FIG. 7 shows an exemplary embodiment of the present invention. The total weight of the sliding profiler 700 consisted of the weight of the housing unit 710 plus the weights of the individual components within the profiler box 720, which consisted of an inclinometer 730, data acquisition board 740, an embedded microcomputer 750, power supply module 760, 12-volt battery 770, and a wireless communication device (not shown) In addition, the sliding profiler included a subsystem for distance measurement, consisting of a distance encoder 780 attached to a pair of wheels 785. A significant portion of the profiler's weight came from the 12-volt battery 770. The bottom of the profiler box is the sliding platform which would contact the wet cement.

The housing unit of 710 may be a chafer pan. Without the need for custom molding, a a minimal amount of machining can put together such an embodiment of the sliding profiler.

The embodiment shown in FIG. 7 was first tested in a sandbox for gliding and surface disturbance evaluation. A 4 ft. by 32 ft. box was constructed and filled with sugar sand, a very fine, cohesion-less material. From sand box tests, modifications were made to increase the contact surface area of the sliding platform. After this modification, the sliding profiler, was tested on freshly poured concrete.

Figure 8:
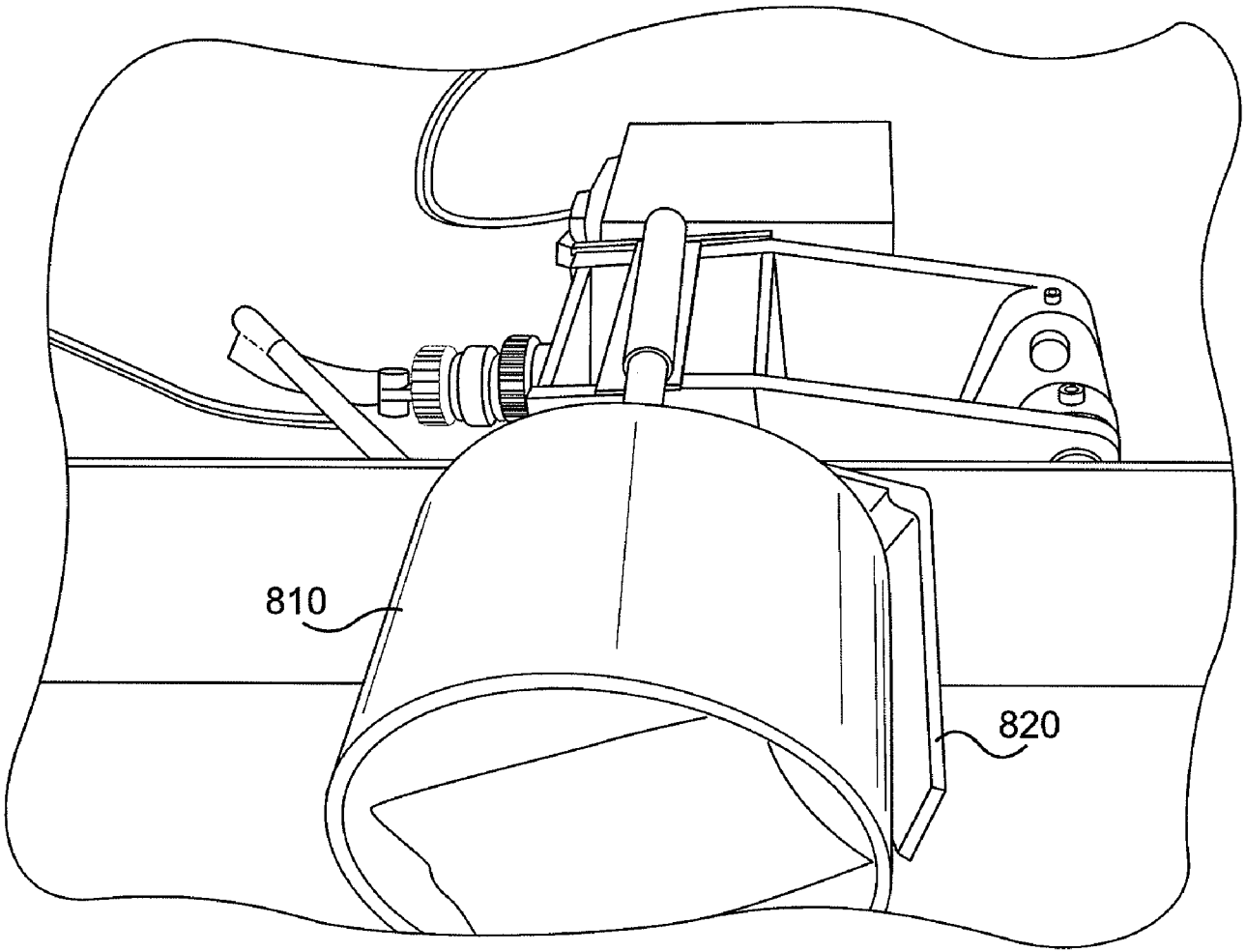
FIG. 8 shows an exemplary embodiment of distance measuring apparatus in accordance with the present invention.

The wheels 785 for distance measuring tended to pick up fresh concrete as evidenced by the pebbled tracks left by the nubby wheels 785. It is possible that an accumulation of fresh concrete could affect the distance measurements, particularly on a paving project where the sliding profiler would be operated over long distances. Yet another embodiment of the present invention employs a smooth wheel 810 and squeegee apparatus 820 in conjunction with the distance meter, as shown in FIG. 8. This new distance apparatus performed without incident.

According to one exemplary embodiment the sliding profiler, shown for example in FIG. 7, was attached to the rear of a paver via a flexible connector, such as a chain or a rope. During some testing periods, the combination of slope and gravity caused the sliding profiler to drift out to the wheel path area of the roadway. In yet other embodiments, the sliding profiler was attached to the rear of the paver with a stable connector that did not permit the sliding profiler to slide sideways out of the wheel path.

Figure 9A:
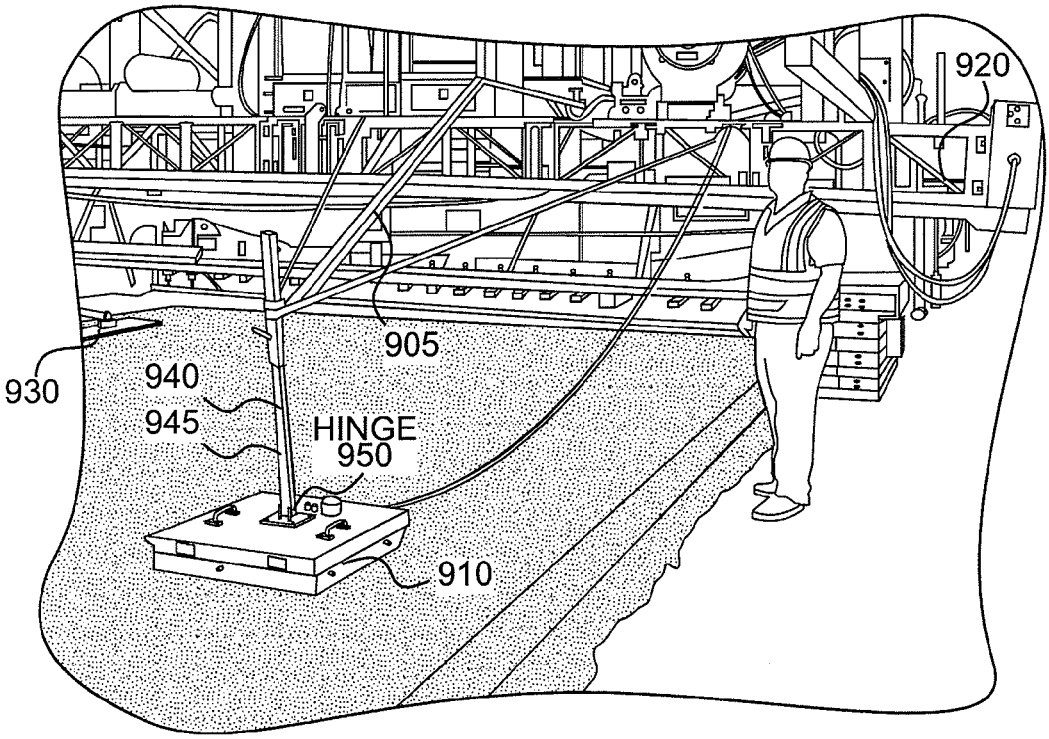
FIGS. 9A-9B show an attachment embodiment of the present invention.
Figure 9B:
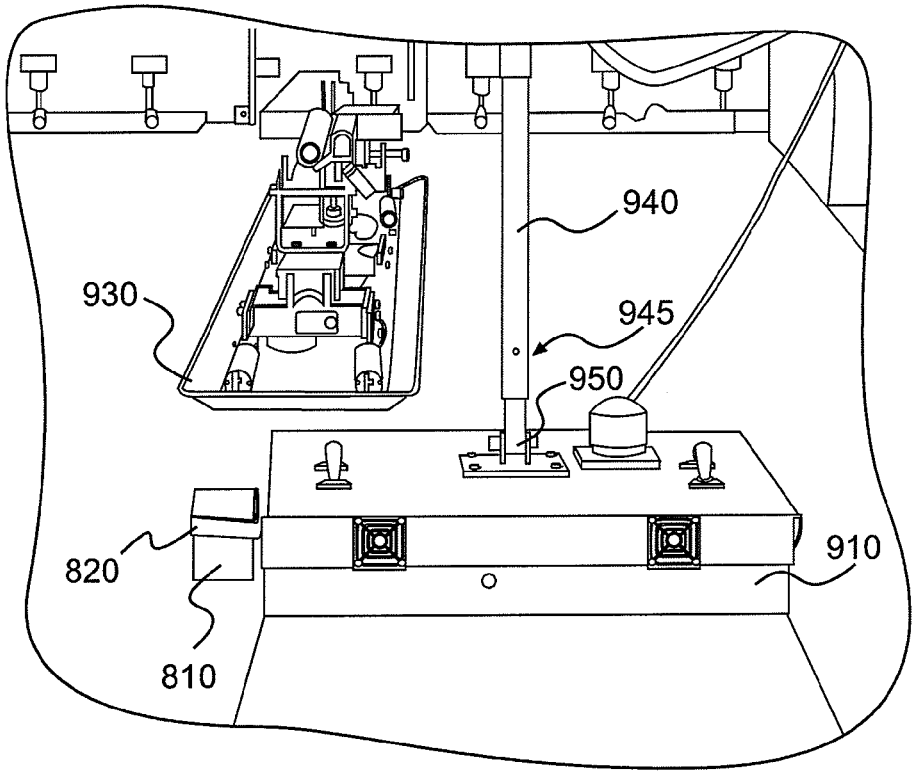

FIG. 9A shows an attachment embodiment of the sliding profiler. The angled bracket 905 is a telescoping rod that permits adjustment of the distance between the profiler 910 and the paver 920. On this particular job, the profiler was positioned so as not to interfere with the operation of the finisher 930, which is shown in part the left side of the FIG. 9A. The vertical bar 940 connecting the profiler to the angled bracket 940 is spring loaded 945 and hinged 950 at the bottom, as shown more particularly in FIG. 9B. This arrangement helps to keep the profiler on the wheel path while permitting pitching motions due to the longitudinal profile of the wet cement surface being laid. The smooth wheel 810 leaves a clean surface on the wet cement and the squeegee 820 prevents cement build up on the distance wheel 810.

According to an exemplary embodiment, a wireless link can be used to send data from the apparatus moving across the wet cement to a portable personal computer or other handheld device such as a PDA.

The profile measurements and bump detection of the sliding profiler made on multiple sections of wet cement roadway were compared to subsequent measurements by the walking profiler on wet cement. Walking profiler measurements were taken in the same wheel path after tining and hardening, about two weeks after the laying of the cement and profile measurements by the sliding profiler. Changes in the concrete surface due to drying will generate a difference between the walking profiler data and the sliding profiler data, however the data results are comparable and support the conclusion that the sliding profiler yields useable results. Both the sliding profiler and the walking profiler measured a 1.5 ft. drop in elevation from a first reference point to a second reference point 100 ft. away.

An exemplary embodiment of the program for acquiring sensor data, from either a gyroscope or an inclinometer, and for profile processing is divided into two parts. A client program initializes the server, sending data acquisition parameters to the server in accordance to the operator commands. The client program also writes the data to a file so that a separate analysis program can process the data, computing the profile and/or bumps. This two part procedure has advantages. For example, the profile processing method and bump detection could be modified using a given data set. A data acquisition server platform is placed into flash memory of an embedded PC. The data acquisition server and recording client programs were written in Visual C++ which can support wireless and ethernet sockets. A wireless network hub is placed on the sliding profiler for communications between the client and server when the sliding profiler was on the wet concrete. An addition to the sliding profiler, a dome of plastic, may be added to allow the signal from the antennae to broadcast out to the job site. The acquired data may be sent via ethernet sockets from the server to the client program located on a laptop.

After the data is recorded, analysis can be performed using, for example, MATLAB (MATHWORKS, Novi, Mich., U.S.A.).

The data acquisition server uses an analog to digital module to convert analog sensor data to digital data. An exemplary embodiment of the main data acquisition and processing components and their interconnections is shown in the block diagram of FIG. 10A.

Figure 10A:
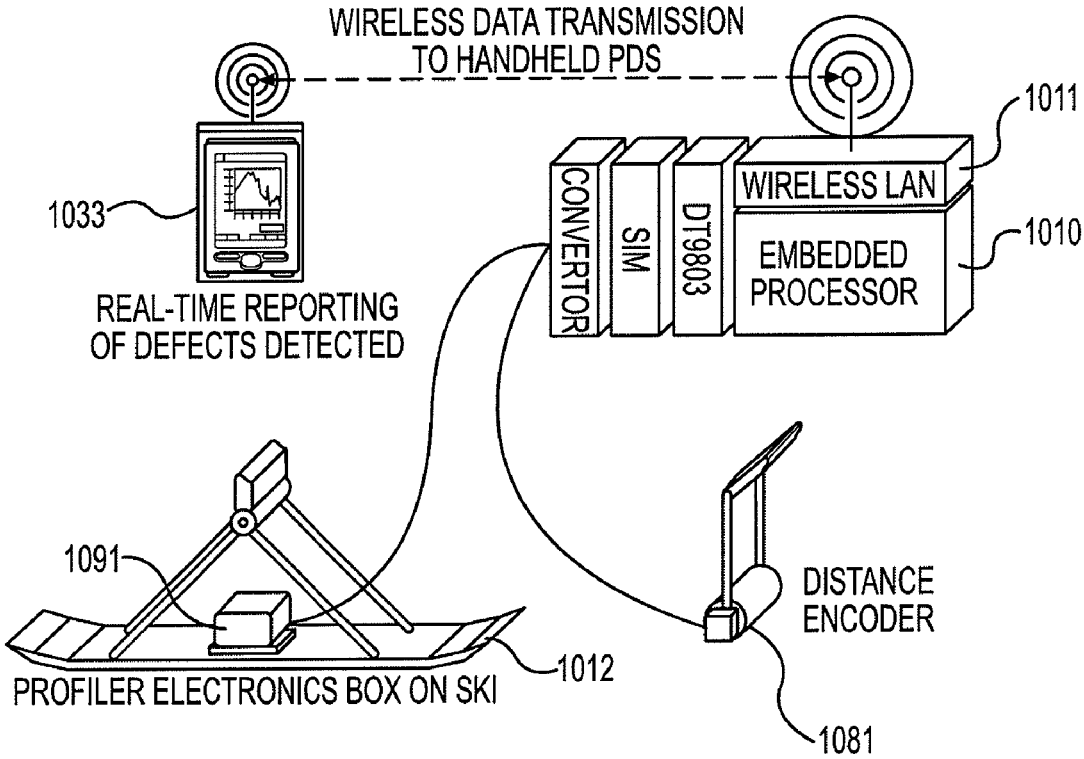
FIGS. 10A-10B shows block diagrams of a sliding profiler in accordance with an exemplary embodiment of the present invention.

In another embodiment, the sliding profiler goes beyond the sensor and distance data collection. In this system, a bump detection algorithm can be internal to the device and run on an embedded processor 1010 (FIG. 10A). The system will be self-contained, and be able to operate without a client program. This alternate sliding profiler embodiment will be able to signal the workers when a profile discrepancy is detected, or even mark the concrete to show where a deformation has occurred.

Initial finishing may carried out by any of the different types of equipment available. Then hand finishing may be done with a straight edge. Floating may then be performed to achieve a smooth finish with the help of long-handled floats. An oscillating surface finisher is typically used for finishing. It may consist of a float type blade about 12 feet long and 1 foot wide with a powered apparatus that oscillates the blade front to rear as it travels transversely across the wet pavement. Another apparatus, that may be used to finish the concrete in case of slip form paving, consists of a tube mounted, on an independent carrier, extending diagonally across the width of the pavement. The tube is dragged back and forth diagonally across the concrete surface. It consolidates concrete by its self-weight and gives it a smooth uniform finish. Using the present invention, surface profile measurements can be taken at any or multiple finishing stages. The final stage may be performed by manual finishers walking behind the paving train, using long-handled trowels.

Figure 10B:
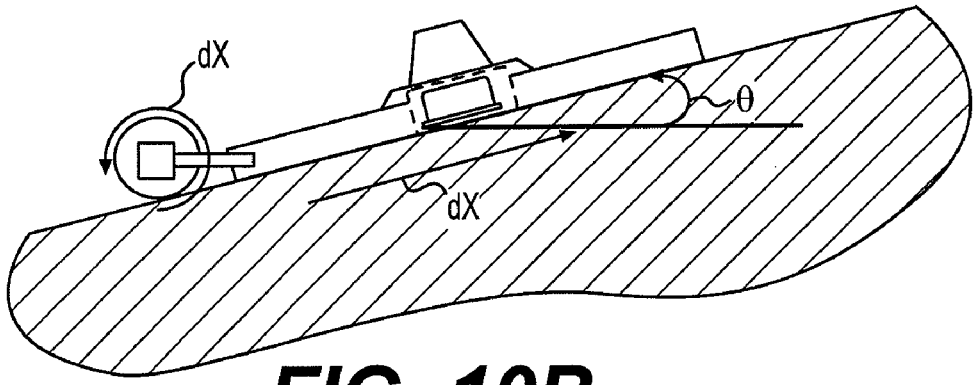

FIG. 10A shows a conceptual illustration of an embodiment of the present invention. The profiler electronics may housed inside a box 1091 that is mounted on a sliding platform 1012. Alternatively, the electronics, except the profile sensor, may be mounted remotely 1011. In the conceptual illustration the sliding platform 1012 resembles a ski shape. Skis, single slalom water skis, surfboards, and snow boards all slide across water or snow while supporting weights in excess of 100 lbs. Any of these platforms could potentially be used or modified to form a sliding platform for use on wet cement, in accordance with the present invention. In an embodiment of the present invention, shown in FIG. 11, a snowboard 1112 is modified, in part, by mounting steel dowels 1115 along the side edges to increase rigidity of the sliding platform. The embodiment also uses a distance encoder on a wheel 1181 which also travels along the wet concrete. Squeegee 1182 prevents cement buildup on wheel 1181. Electronics box 1111 houses the data acquisition board and power-supply, gyroscope, and embedded processor. Data from the profiler may be transmitted through a wireless LAN 1011, as shown in FIG. 10. The operator may be able to view measurements made with the profiler using a portable notebook computer 1033, which will report bumps detected by the system and their locations, for correction by the finishers at the site.

Figure 11:
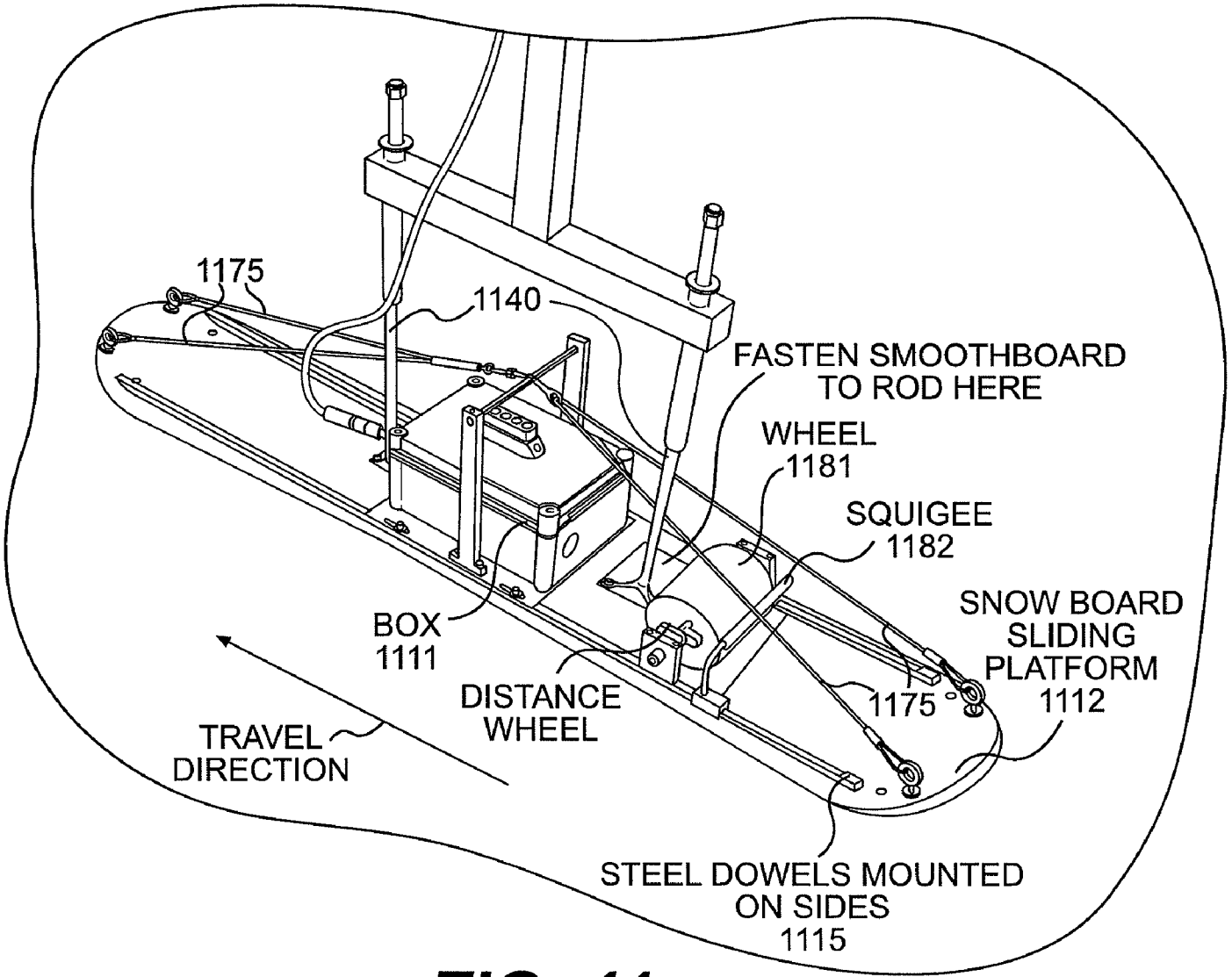
FIG. 11 shows another exemplary embodiment of the sliding profiler.
Figure 12:
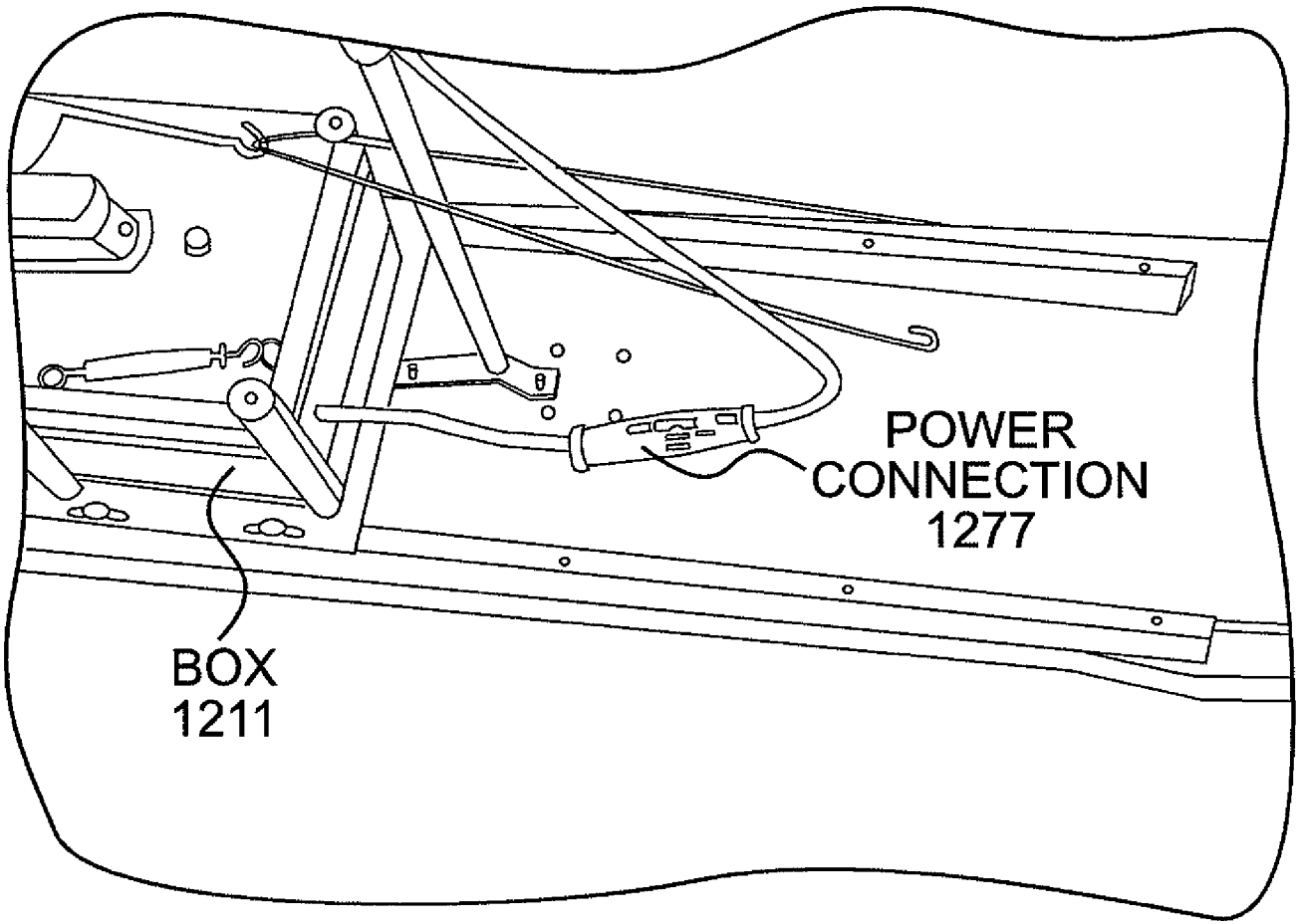
FIG. 12 shows the power connection to the electronics box on the sliding profiler in accordance with an embodiment of the present invention.

In the embodiment of FIG. 11, power to the box 1211 is supplied to the sliding profiler through a power cord connection 1277, foregoing the need for supporting a heavy 12 volt battery on the sliding platform, as shown in FIG. 12.

Figure 13:
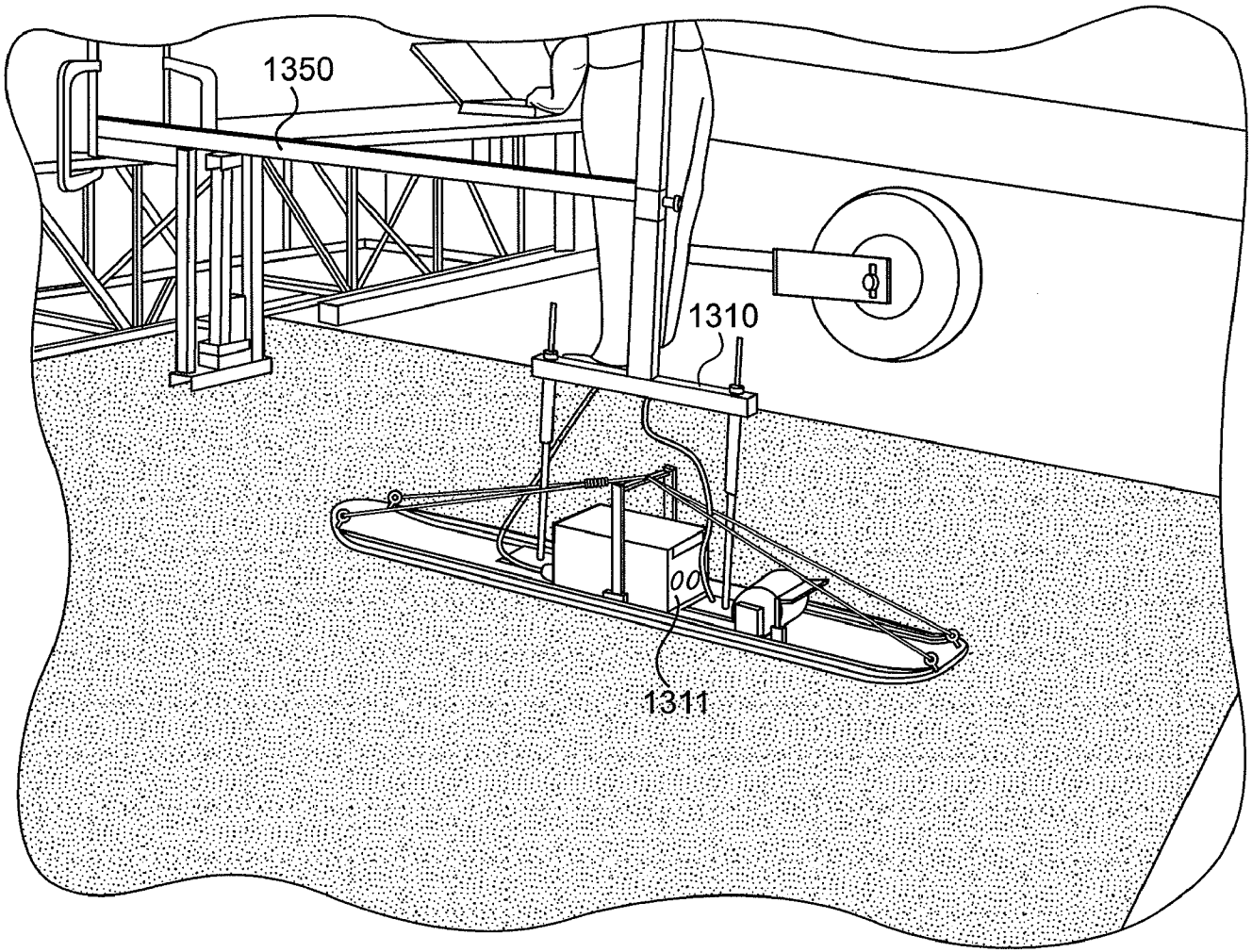
FIG. 13 shows a means for connecting sliding profiler to a working bridge via an adjustable arm.

The floating rods 1140 isolate the mechanical vibrations of the paver from the movement of the sliding profiler board 1112, contributing to the ability of the sliding profiler to measure cement profile. The tension lines 1175 help to keep the sliding profiler free from vibrations, allowing a truer profile measurement. Turning to FIG. 13, the T-bracket 1310 keeps the profiler balanced front to back across the gyroscope (not shown) housed in box 1311.

FIG. 13 shows connection of the floating rods to the sliding profiler, and connection of the T-bar to a working bridge via an adjustable arm 1350. As is readily understood by one of ordinary skill, the adjustable arm may be attached to various pieces in the paving train.

According to one embodiment of the sliding profiler, WINDOWS CE loads and executes a CE profiler program (MICROSOFT, INC., Seattle, Wash., U.S.A.). The CE profiler program is responsible for collecting data from the sensors attached to the system and applying bump detection algorithm.

There may be two lights or light emitting diodes attached to the system; one of them functioning as a ready indicator light, blinking while the electronics are working properly. Another light, functioning as a beacon or visual signal turning on when a bump is detected. In alternate embodiments, a chirping sound is made using a sound card and a speaker housed in the electronics box.

Figure 14:
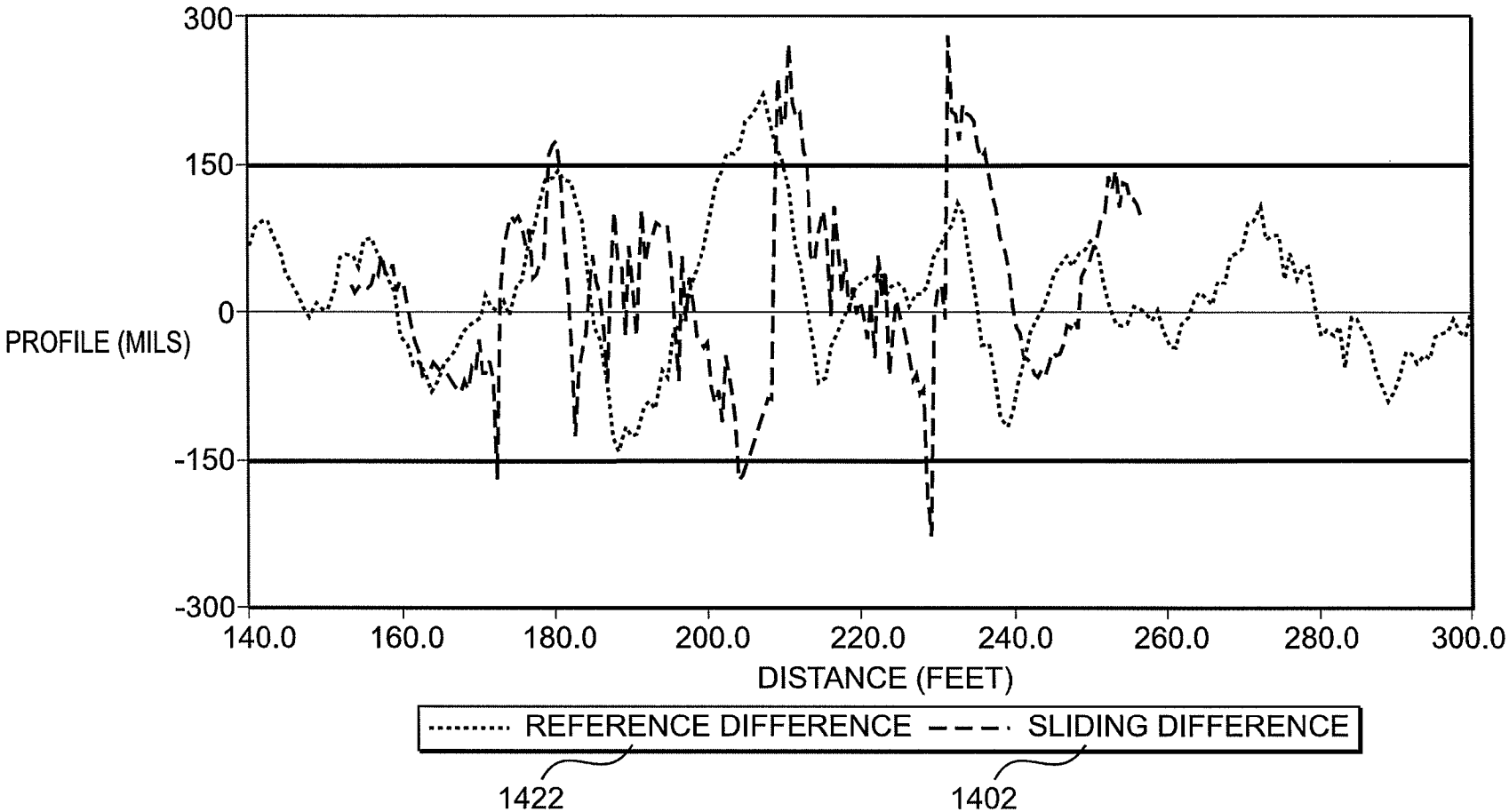
FIG. 14 shows a comparison of a wet profile measured with an embodiment of the sliding profiler and the corresponding set profile measured with walking reference profiler.

FIG. 14 shows a comparison of a wet profile measured with an embodiment of the sliding profiler 1402, such as the embodiment of FIG. 11 and the corresponding set profile measured with walking reference profiler 1422. The graph shows vertical profile in mils as a function of distance (feet). The sliding profiler, like the walking profiler on set cement, displays profile sensitivity of less than 150 mils. There is expected to be a difference between the two measurements as changes in cement surface profile are inherent in, for example, the drying and curing process. The walking (reference) profiler measurements are offset on the distance axis from the sliding profiler data by about 5 ft. These results support the conclusion that the sliding profiler will provide accurate profile deviations, bumps or divets, down to the 150 mil range.

The sliding profiler invention is inexpensive, using a sensor attached to a sliding platform, which slides along wet cement.

It measures the profile and determines any bumps along the path of travel. It can be attached to the paver, finisher, a working bridge, or other paving train equipment. Multiple sliding profilers can be used at different stages in the paving train and in different positions across the width of the cement pour. This device will allow contractors to locate, fix bumps, and then check for bumps again, for example, if using a bridge, all while the concrete is still fresh. The implementation of this device will improve the general smoothness characteristic of CRC pavements and other pavement types. This device may eliminate the need to use grinding operations to improve riding quality of pavements reducing costs, to contractors, for example.

Figure 15:
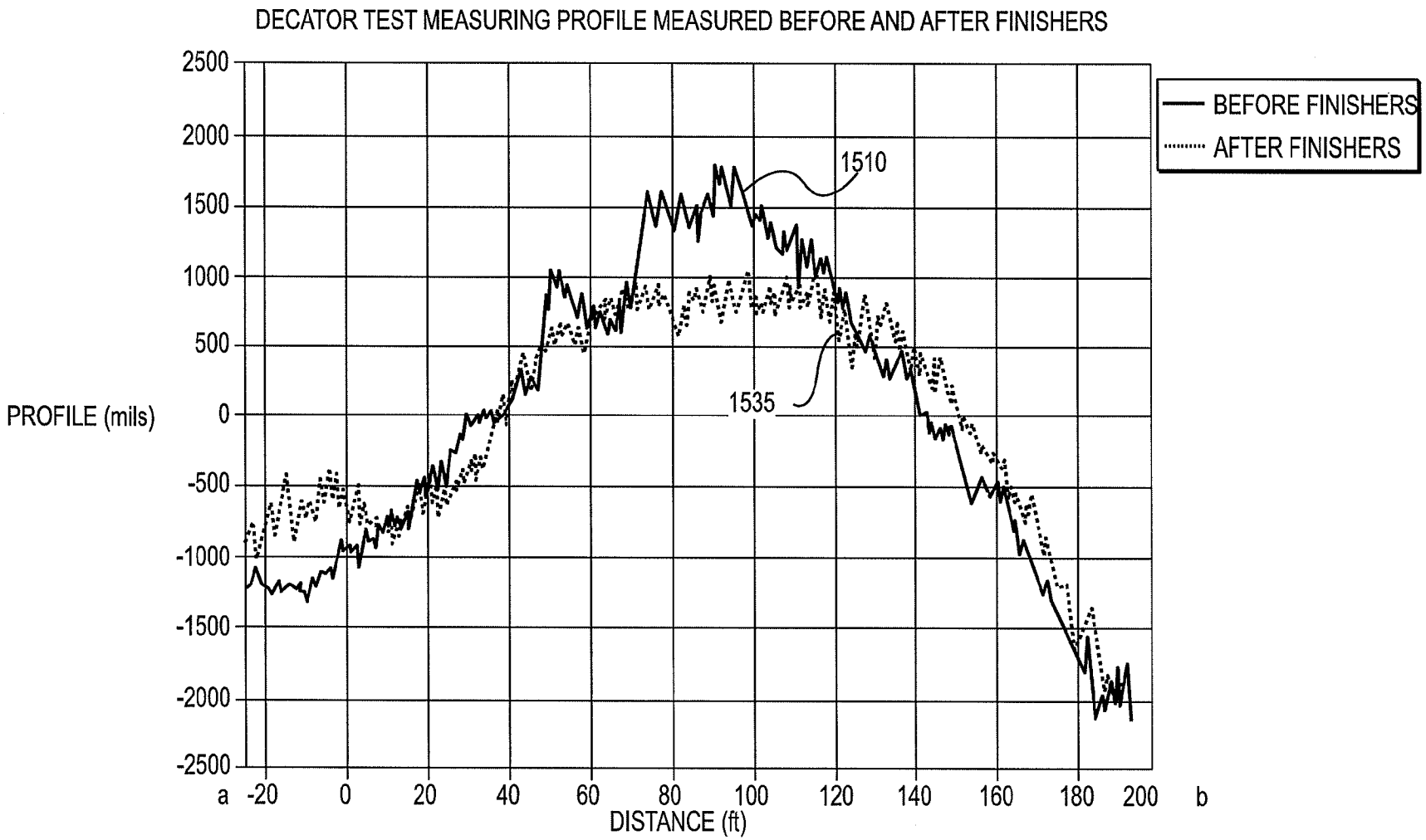
FIG. 15 shows a wet profile measured with the present invention before and after additional finishing work.

FIG. 15 shows a profile measurement from a distance from a to b, of 220 feet, using the sliding profiler 1510. Upon identification of a bump the cement under went additional finishing by hand. The sliding profiler measured the profile of the wet cement after the additional finishing 1535 and a significant reduction in the bump was measured. Cement profile (mils) is shown as a function of distance (ft).

In alternate embodiments, the bump detection system may include a real-time profile computation capability as well as the addition of global positioning system so that profile can be compared with reference measurements. An operator control console and interface could be included along with the bump indicator to report location, height and width of bump, and to provide a summary of defects found at the end of the day's production.

FIGS. 16A-16D show a relationship of calculations and variables to a sliding profiler in accordance with an exemplary embodiment of the present invention. Embodiments of the present invention can capture the vertical displacement of the sliding platform with as few devices as possible. Some platform, perhaps a ski or a cart, is traveling across the surface. As the platform travels, the distance traveled can be found by using a distance encoder with a fixed number of pulses (A) per rotation. The distance of each pulse (dX) can be either calibrated from a test surface or calculated by using the circumference of the wheel, where circumference (C) and distance of each pulse (dX) is calculated as shown in equations 1 and 2 below, where radius is the radius of the wheel.

$$C=(2)(\text{radius})(pi) \quad (1)$$

$$dX=C/A. \quad (2)$$

Figure 16A:
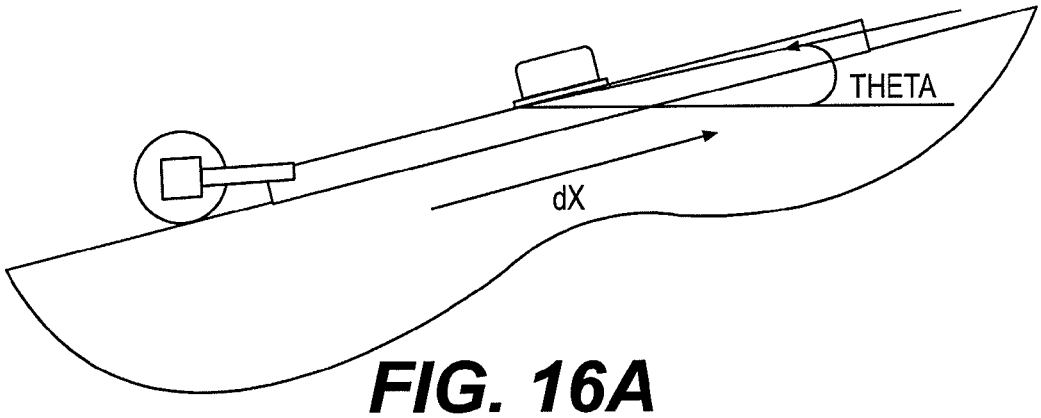
FIGS. 16A-16D show a relationships of calculations and variables used with a sliding profiler in accordance with an exemplary embodiment of the present invention.
Figure 16B:
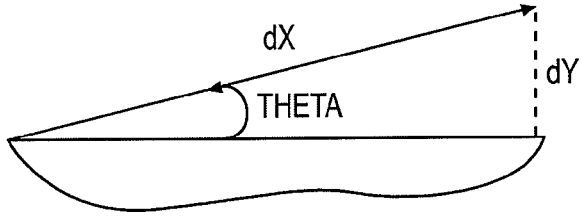

As an example, a wheel with a 0.1 ft radius is connected to a distance encoder, which outputs 64 pulses (A) per rotation. C will equal 0.6283 ft., and dX will be 0.009817 ft., (0.6283 ft./64). At the same time, a second instrument records the angle of inclination (Theta) of the vehicle at the time the travel distance is measured, as shown for example in FIG. 16A. So, for each point along the distance of travel, a known angle can be applied to a known path of travel, dX, as shown in FIG. 16A. A change in height (dY) can be calculated from corresponding dX and Theta values, according to the relationship shown in FIG. 16B.

Using known incremental profile changes dY, a current profile with respect to a start position of a platform at a given point is the summation of all the profile changes, and the position of the data is the summation of all the distance changes dX, as summarized by the equations below.

$$dY=dX \sin(\text{Theta}) \quad (3).$$

$$\text{Distance}=\Sigma dX \quad (4).$$

$$\text{Profile}=\Sigma dY \quad (5).$$

An undesirable bias can be present in readings of the inclinometer. To compensate for this bias, it can be calculated and removed using a moving average window of certain length (B) of B profile points calculated immediately before the current profile point (Profile(n)), as shown below in Equation 6 in reference to FIG. 16C.

$$\text{Bias}(n) = \frac{\sum(\text{Profile}(n-B) \ldots \text{Profile}(n))}{B}. \quad (6)$$

$$\text{AdjProfile}(n)=\text{Profile}(n)-\text{Bias}(n) \quad (7).$$

Figure 16C:
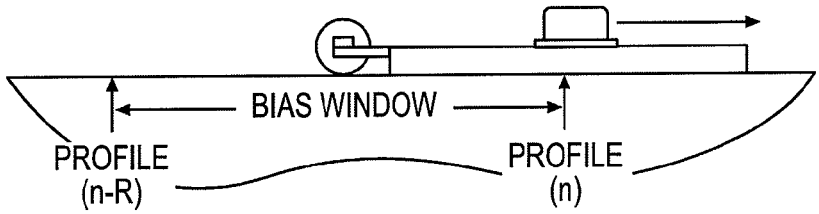
Figure 16D:
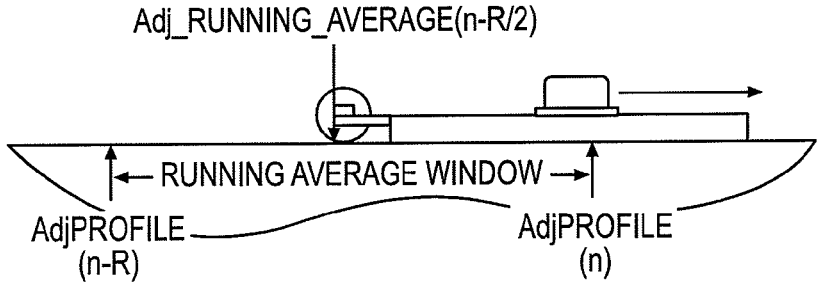

The adjusted profile, AdjProfile is calculated as shown in Equation 7, also in reference to FIG. 16C. Drift correction is also possible with present invention by matching desired beginning and ending points to a rod and level reference and calculating the corresponding bias for points there between.

The running average of the profile is used in detecting deformities or variations (bumps) in the wet concrete. This running average can be calculated using a moving average window of length R with respect to the point at n-R/2 and where the right most point of the window being the current profile point (Profile(n)), where the running average, Running_Average, and adjusted running average, Adj_Running_Average, are calculated using the Equations (8) and (9), respectively, and in reference to FIG. 16D.

$$\text{Running_Average}(n-R/2)=(\text{Profile}(n-R) \ldots \text{Profile}(n))/R \quad (8).$$

$$\text{Adj_Running_Average}(n-R/2)=(\text{AdjProfile}(n-R) \ldots \text{AdjProfile}(n))/R \quad (9).$$

The difference between the adjusted profile(with removed bias) and the running average is used to locate deformities in the fresh concrete, as shown in Equation 10.

$$\text{Difference}(n)=abs(\text{AdjProfile}(n)-\text{AdjRunning_Average}(n)) \quad (10).$$

As shown in Equation 10 the difference value, Difference (n), according to this embodiment is an absolute value. A deformity, bump or divet, is located in the wet concrete with respect of a pivot point in the running average window. The sliding profiler uses the middle point of the running average window for calculating the deviation of the adjusted profile and the running average. A deviation above certain threshold is considered a bump. If Difference(n) is greater than threshold, then a deformity at point (n) exists, else there is no deformity.

Embodiments of the present invention were thoroughly tested and results support that the sliding profiler is able to detect bumps or indents in the pavement with a sensitivity to of less than 150 mils. Referring to FIG. 14, the sliding profiler measures a bump 14-10

Summarizing some of the desirable aspects achieved with the present invention, the sliding profiler: glides on wet concrete; is affordable so that contractors may purchase multiple units to monitor the wheel paths of the travel lanes and to check the work of finishers; is easy to use; is rugged having workmanship that withstands rigors of the construction environment, e.g. machine vibrations, water sprays, chemical; mounts on existing equipment; and shows defect locations.

While specific alternatives to steps of the invention have been described herein, additional alternatives not specifically disclosed but known in the art are intended to fall within the scope of the invention. Thus, it is understood that other applications of the present invention will be apparent to those skilled in the art upon reading the described embodiment and after consideration of the appended claims and drawing.

What is claimed is:

1. A sliding profiler apparatus for detecting discrepancies in wet cement, the apparatus comprising:

an inclinometer which records incline data;

a distance meter which records distance data;

a processor for calculating a profile of wet cement from the incline data and the distance data and for determining the presence of a discrepancy and generating a discrepancy detection signal;

a sliding platform coupled to the inclinometer, the sliding platform configured to slide in contact with the surface of wet cement;

a power connection; and a discrepancy indicator which activates upon discrepancy detection;

where the apparatus is configured such that if the sliding platform is in contact with wet cement, the inclinometer can measure the incline of the wet cement by measuring the incline of the sliding platform.

2. The apparatus according to claim 1, wherein the discrepancy indicator is a flashing light.

3. The apparatus according to claim 1, wherein the discrepancy indicator is an audible signal.

4. The apparatus according to claim 1, further comprising:

a wireless connector between sensors on the sliding profiler;

a computing device wirelessly connected to receive incline data and distance data; and a battery for remote power.

5. A sliding profiler apparatus for detecting discrepancies in wet cement, the apparatus comprising:

a gyroscope which records profile data;

a distance meter which records distance data;

a processor for calculating a profile of wet cement from the incline data and the distance data and for determining the presence of a discrepancy and generating a discrepancy detection signal;

a sliding platform coupled to the inclinometer, the sliding platform configured to slide in contact with the surface of wet cement;

a power connection; and a discrepancy indicator which activates upon discrepancy detection;

wherein the apparatus is configured such that if the sliding platform is in contact with wet cement, the gyroscope can measure the incline of the wet cement by measuring the incline of the sliding platform.

6. The apparatus according to claim 5, further comprising:

a stiffening means mounted on the sides of the sliding platform.

7. A sliding profiler apparatus for detecting discrepancies in wet cement, the apparatus comprising:

a gyroscope which records profile data; a distance meter which records distance data;

a processor for calculating a profile of wet cement from the incline data and the distance data and for determining the presence of a discrepancy and generating a discrepancy detection signal;

a sliding platform;

a power connection;

a discrepancy indicator which activates upon discrepancy detection; and tension lines spanning the length of the sliding platform minimizing vibrations in the platform.

8. A sliding profiler apparatus for detecting discrepancies in wet cement, the apparatus comprising:

a gyroscope which records profile data; a distance meter which records distance data;

a processor for calculating a profile of wet cement from the incline data and the distance data and for determining the presence of a discrepancy and generating a discrepancy detection signal;

a sliding platform;

a power connection;

a discrepancy indicator which activates upon discrepancy detection; and floatation rods mounted on the sliding platform, wherein the sliding profiler is connected to a stage in a paving train via the floatation rods, and wherein the floatation rods isolate vibration originating from a stage in the paving train from the sliding profiler and maintain flatness of the sliding platform.

9. The apparatus according to claim 8, wherein the floatation rods connect to a T-bracket.

10. The apparatus according to claim 9, further comprising a spring loaded cantilever connected to the T-bracket.

11. The apparatus according to claim 1, wherein, the sliding platform is a ski type platform.

* * * * *